US006571578B2

(12) United States Patent
Akyol

(10) Patent No.: US 6,571,578 B2
(45) Date of Patent: Jun. 3, 2003

(54) REVERSIBLE ORNAMENTAL JEWELRY ARTICLE

(76) Inventor: Hasan Akyol, 55 W. 47th St., New York, NY (US) 10036

( * ) Notice: Subject to any disclaimer, the term of this patent is extended or adjusted under 35 U.S.C. 154(b) by 0 days.

(21) Appl. No.: 09/887,760

(22) Filed: Jun. 22, 2001

(65) Prior Publication Data

US 2002/0194867 A1 Dec. 26, 2002

(51) Int. Cl.[7] ..... A44C 5/00

(52) U.S. Cl. ..... 63/3; 63/4; 63/38; 59/80; 59/84

(58) Field of Search ..... 63/3, 4, 9, 38; 59/80, 84

(56) References Cited

U.S. PATENT DOCUMENTS

| | | | | | |
|---|---|---|---|---|---|
| D13,318 | S | | 9/1882 | Lieb | |
| 888,057 | A | * | 5/1908 | Barney | 63/4 |
| D42,643 | S | * | 6/1912 | Meyers | D11/90 |
| 1,189,497 | A | * | 7/1916 | Schwartzman | 59/80 |
| 1,319,201 | A | * | 10/1919 | Boldizsar | 63/4 |
| 1,894,195 | A | | 1/1933 | Pulver | |
| D117,580 | S | | 11/1939 | Sand | |
| 2,518,163 | A | | 8/1950 | Megar | |
| 2,699,035 | A | | 1/1955 | Becker | |
| 2,714,269 | A | | 8/1955 | Charles | |
| 3,820,201 | A | | 6/1974 | Burckhardt | |
| 4,014,079 | A | | 3/1977 | Camarda | |
| D257,333 | S | | 10/1980 | Hofman | |
| 4,625,508 | A | | 12/1986 | Fontana | |
| 4,878,364 | A | * | 11/1989 | Freilich | 63/28 |
| D305,514 | S | | 1/1990 | Bulgari | |
| D305,517 | S | | 1/1990 | Bulgari | |
| D313,200 | S | | 12/1990 | Bulgari | |
| D315,697 | S | | 3/1991 | Bulgari | |
| 5,097,680 | A | | 3/1992 | Lin | |
| D337,068 | S | | 7/1993 | Bichi | |
| D376,545 | S | | 12/1996 | Bulgari | |
| 5,655,300 | A | * | 8/1997 | Gruppach | 29/896.411 |
| 6,023,946 | A | | 2/2000 | Magi | |
| 6,101,842 | A | | 8/2000 | Delacretaz | |
| 6,412,304 | B1 | * | 7/2002 | Adelman | 63/26 |

* cited by examiner

*Primary Examiner*—James R. Brittain
*Assistant Examiner*—Andrea Chop
(74) *Attorney, Agent, or Firm*—Stephen E. Feldman

(57) ABSTRACT

A reversible ornamental article of jewelry having a plurality of ornamental links hinge ably secured to one another to form a flexible strand of jewelry, which can be in the form of a necklace or bracelet. The geometric configurations of the links in one planar surface differ from one another and also differ from one another in the opposite or reverse planar surface so that the jewelry article can be worn to display the ornamental geometric configurations in either planar surface. A pin or other connecting device passing through each link attaches the links to one another. This secures the links together to allow the jewelry article to be both flexible and reversible.

20 Claims, 2 Drawing Sheets

REVERSIBLE ORNAMENTAL JEWELRY ARTICLE

FIELD OF THE INVENTION

This invention is directed to a reversible ornamental article of jewelry. More particularly, this invention is directed to an article of jewelry whose interconnecting links on one planar surface have geometric configurations that are different from one another and are different from the geometric configurations on the reverse or opposite planar surface. Even more particularly, this invention is directed to a reversible ornamental jewelry article that can be in the form of a necklace, an arm bracelet, a wrist bracelet, or an ankle bracelet.

BACKGROUND OF THE INVENTION

The ornamental jewelry industry is replete with a variety of ornamental designs and geometric configurations for necklaces, wrist and arm bracelets, ankle bracelets, wristwatch straps and bands, and the like. However, these ornamental articles of jewelry are typically crafted so that only one planar surface can be exposed to a viewer while the opposite or reverse side is placed against or rests upon the body of the wearer and is not intended for display.

For example, U.S. Pat. No. 1,894,195 to Pulver discloses an ornamental bead chain having button beads with polygonal facets and disc shaped members alternately strung on a string between each bead.

U.S. Pat. No. 2,518,163 to Megar discloses a bracelet for a wristwatch having links pivotally connected to one another, each link having an upper portion and a lower portion that is adapted to be fitted into the upper portion.

U.S. Pat. No. 2,699,035 to Becker discloses ornamental strip bodies used to manufacture bracelets. Individual links are secured to one another by means of link pins and the strip bodies are formed with tooth-like projections designed to engage adjacent links in an interlocking relationship.

U.S. Pat. No. 2,714,269 to Charles discloses an ornamental beaded necklace the beads of which are provided with projecting heads arranged to engage mating sockets.

U.S. Pat. No. 3,820,201 to Burckhardt discloses an ornamental link having a pair of elongated decorative members connected across the middle portion thereof and which diverge outwardly there from to form a V-shape.

U.S. Pat. No. 4,014,079 to Camarda discloses an ornamental bracelet having a first fastening element having a semicircular support portion and a catch pin affixed to the support. A second fastening element is provided with a spherical hook and a slot for receiving the pin of the first element.

U.S. Pat. No. 4,625,508 to Fontana discloses a hinged bracelet having a plurality of inter-engaging, pivotally connected flat link members.

U.S. Pat. No. 5,097,680 to Lin discloses an annular shaped, ornamental bracelet whose color and patterns can be changed by rotating a cylindrical rim member.

U.S. Pat. No. 6,023,946 to Magi discloses a decorative chain having a plurality of small hollow ball members connected to one another by a segment engaging means.

U.S. Pat. No. 6,101,842 to Delacretaz discloses an ornamental bracelet having decorative and support elements connected to one another by means of pins.

As can be seen, none of the articles disclosed in the foregoing patents discloses or suggests an ornamental article of jewelry having different geometric configurations on each of its planar surfaces and whose adjacent, interconnected link members have geometric configurations that differ from one another so that either planar surface can be exposed for display.

SUMMARY OF THE INVENTION

The reversible ornamental jewelry article of the invention is formed from alternating links having different geometric configurations on one planar surface and different geometric configurations on the opposite or reverse side planar surface. Thus, a person wearing the jewelry article can display one planar surface during one time of the day, such as at a lunch function, and then turn the article over to display the reverse side or other planar surface during another time of the day, such as at a dinner party. This versatility is particularly appealing to persons having busy schedules as it permits them to carry fewer articles of jewelry during the day while offering a selection of jewelry ornamentation to wear and display. In general, the reversible ornamental jewelry article of the invention comprises: a plurality of first link members; a plurality of second link members disposed between and hinge ably secured to said first link members, said first and second link members collectively forming a strand of ornamental jewelry having a substantially planar upper surface, a substantially planar lower or reverse surface and opposed ends, the geometric configuration of said first link members being different from the geometric configuration of said second link members in said upper planar surface and the geometric configuration of said first link members being different from the geometric configuration of said second link members in said lower or reverse planar surface; and, means to secure said opposed ends to one another.

In one embodiment the geometric configuration of said first link members in said upper and lower planar surfaces is X-shaped.

In another embodiment the geometric configuration of said second link members in said upper planar surface is different from the geometric configuration of said second link members in said lower or reverse planar surface.

In a further embodiment, the ornamental jewelry strand includes a plurality of additional link members each having, geometric configurations differing from one another as well as differing from said first and second link members.

BRIEF DESCRIPTION OF THE DRAWING

The reversible ornamental jewelry article of the invention is further illustrated in the accompanying, drawing wherein.

DETAILED DESCRIPTION OF THE DRAWING AND THE INVENTION

Figure 1:
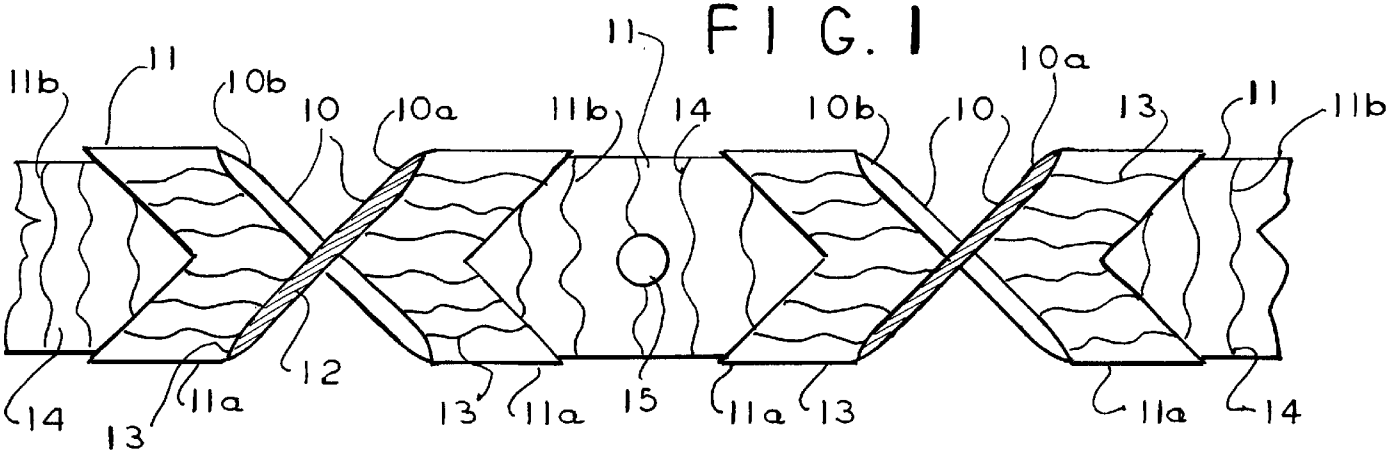
FIG. 1 is an exaggerated plan view of the upper planar surface of a segment of the jewelry article of the invention.

The reversible ornamental jewelry article of the invention will become more apparent from the ensuing, description when considered together with the accompanying drawing, wherein like reference numerals and letters denote like parts and wherein preferred embodiments of the invention are illustrated.

Figure 6:
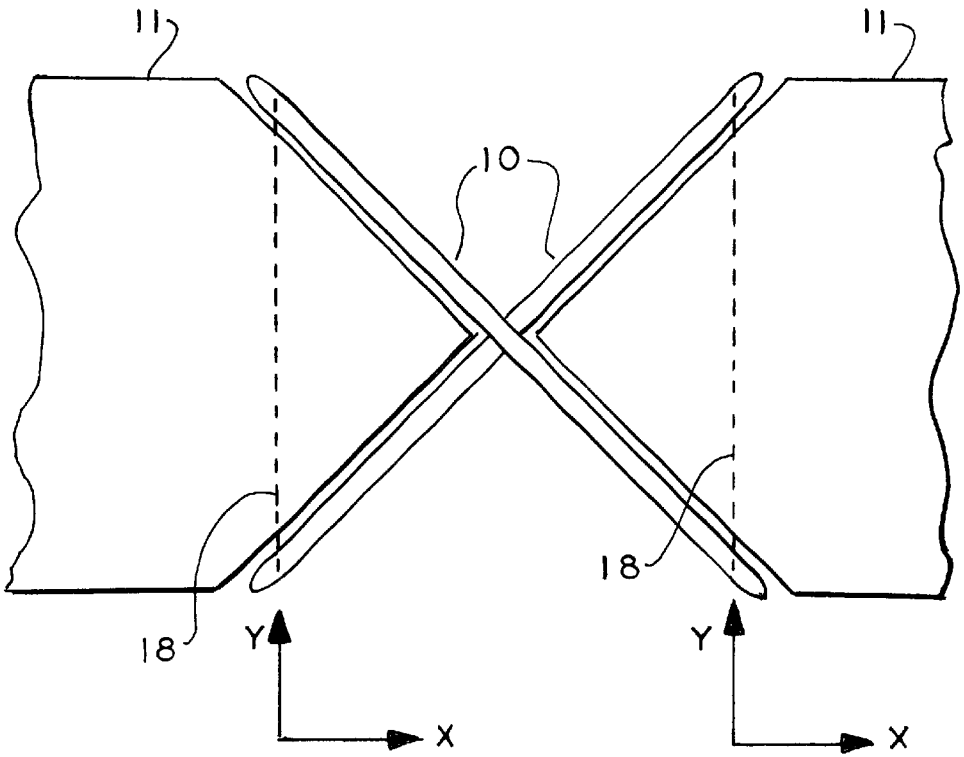
FIG. 6 shows the parts of the links with a connecting pin.
Figure 7:
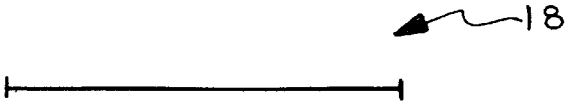
FIG. 7 shows the connecting pin.

As shown in FIG. 1, the jewelry article of the invention is formed from a plurality of first link members 10 having an X-shaped geometric configuration with one arm 10*a* of the X-shaped member crossing over the other arm 10*b* of the X-shaped member. A plurality of second link members 11 are disposed between and hingably secured to the X-shaped members by conventional means such as connecting pins 18, shown in FIGS. 6 and 7, so that the first link members and the second link members collectively form a flexible strand of ornamental jewelry that permits a planar surface of the jewelry strand to lie flat against the body of a person wearing the article. The pins 18 pass through holes in the first link 10 and the second link 11, and travel on a parallel plane to both planar surfaces. Subsequent to insertion between the two links, each pin 18 is flattened on either end, as shown in FIG. 7, in order to be held in place. With the pin in place, both links can rotate along the y-axis, as shown in FIG. 6. This connection allows for enough flexibility that the article may be worn with either planar surface facing away from the body while the other surface lies flat against the body. This is important to allow for the full use of the reversible feature. The opposed ends of the jewelry strand (not shown) can be secured to one another by conventional means such as a bayonet clip, a spring-loaded hook and an eye, and the like.

In the embodiment shown in FIG. 1, the geometric configuration of the second link members 11 is in the form of a hexagon 11*a* with a central hexagonal portion 11*b*. In this embodiment, one arm of the X-shaped member is provided with a first design as indicated by the cross-hatch lines 12, the hexagonal second link member is provided with a second design as indicated by the horizontal wavy lines 13 and the central hexagonal portion is provided with a third design as indicated by the vertical wavy lines 14. A precious or semi-precious gemstone 15 can be optionally set in the center of the central hexagonal portion.

Figure 2:
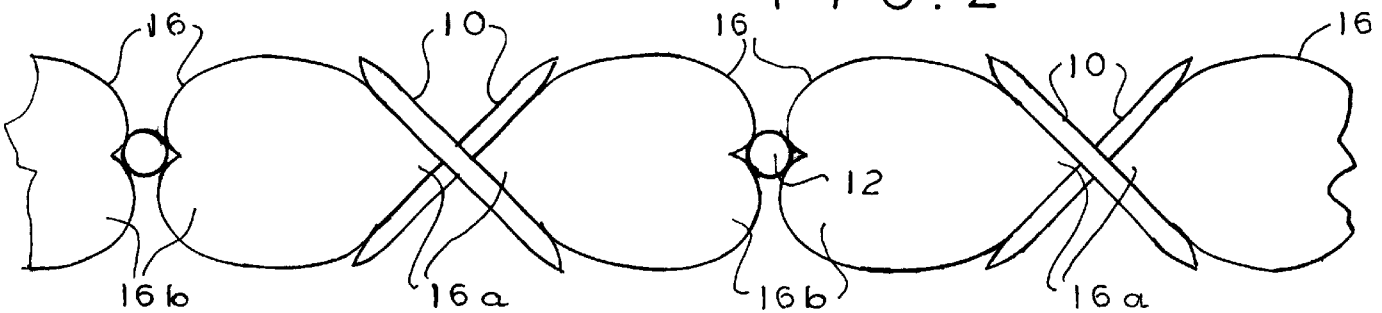
FIG. 2 is a plan view of the lower or reverse planar surface of the jewelry article shown in FIG. 1; and, FIGS. 3, 4 and 5 are exaggerated plan views of additional link members having geometric configurations differing from the geometric configurations of the link members shown in FIGS. 1 and 2.

As can be seen in FIG. 2, the lower or reverse planar surface of the jewelry strand contains X-shaped members corresponding to those shown in FIG. 1. However, the geometric configuration of the second link members 16 corresponding to the second link members 11 shown in FIG. 1 have a dual heart shape the longitudinal axes of which are disposed substantially parallel to the longitudinal axis of the jewelry strand. In this embodiment, the apexes 16*a* of each of the hearts is nested into the point where the arms of the X-shaped members meet while their rounded portions 16*b* abut on another. A precious or semi-precious gemstone 17 can also optionally be set between the rounded heart portions.

Figure 4:
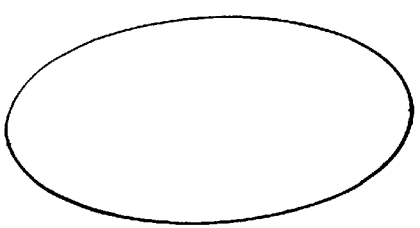
Figure 3:
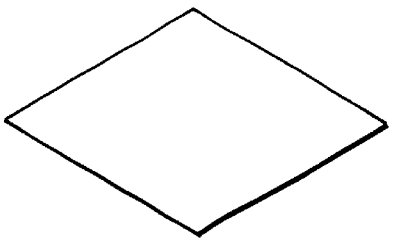
Figure 5:
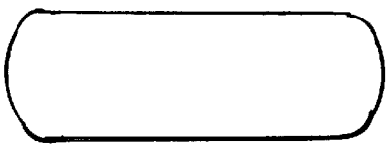

The jewelry strand can include a plurality of one or more additional link members having geometric configurations that differ from one another and that also differ from the geometric configurations of the first and second link members illustrated in FIGS. 1 and 2. For example link members having an elongated diamond configuration as shown in FIG. 3 or an oblong configuration as shown in FIG. 4 or a rectangular configuration as shown in FIG. 5 are illustrative of additional link members that can be included in the jewelry strand. The said first link member shall always be of a shape allowing for the connection of the link members. However, the said second link member can be any combination, on its upper and lower planar surfaces, of the other shapes set forth above.

The reversible ornamental jewelry article of the invention can be provided in the form of a necklace, and arm bracelet, a wrist bracelet or ankle bracelet depending upon the length in which it is manufactured.

Thus, while the reversible ornamental jewelry article of the invention has been described with particularity and in some detail, it will be appreciated by those skilled in the art that changes and modifications can be made therein without departing from the scope and spirit of the invention.

What is claimed:

1. A reversible ornamental jewelry article having decorative finishes on both sides comprising:

a. a plurality of first link members:

b. a plurality of second link members disposed between and hingably secured to said first link members, said first and second link members collectively forming a flexible strand of ornamental jewelry having a substantially planar upper surface, a substantially planar lower or reverse surface and opposed ends, the geometric configuration of said second link members being different in said upper and lower or reverse planar surfaces, the geometric configuration of said first link members being different from the geometric configuration of said second link members in said upper planar surface and the geometric configuration of said first link members being different from the geometric configuration of said second link members in said lower or reverse planar surface;

c. a pin passing through said link members to secure said links together whereby the jewelry article is reversible; and, d. means to secure said opposed ends to one another.

2. The jewelry article of claim 1 wherein the geometric configuration of said first link members in said upper and lower or reverse planar surfaces is X-shaped.

3. The jewelry article of claim 2 wherein an arm of each of said X-shaped link members crosses over another arm of each of said X-shaped link members.

4. The jewelry article of claim 3 wherein one arm of one of said X-shaped members has a first ornamental design thereon.

5. The jewelry article of claim 1 which includes a plurality of additional link members each of which has a geometric configuration differing from one another and differing from the geometric configurations of said first and said second link members.

6. The jewelry article of claim 5 wherein the geometric configuration of said additional link members is selected from the group consisting of elongated diamonds, oblongs and rectangles.

7. The jewelry article of claim 1 wherein the geometric configuration one of said second link members in said upper planar surface is in the form of a hexagon.

8. The jewelry article of claim 7 wherein said hexagon includes a central hexagonally shaped portion.

9. The jewelry article of claim 8 wherein said central hexagonally shaped portion has a third ornamental design thereon.

10. The jewelry article of claim 9 wherein a precious or semi-precious gemstone is set in the center of said central hexagonally shaped portion.

11. The jewelry article of claim 7 wherein said hexagon has a second ornamental design thereon.

12. The jewelry article of claim 1 wherein the geometric configuration of one of said second link members in said lower or reverse planar surface is in the form of a dual heart the longitudinal axes of which are substantially parallel to the longitudinal axis of said jewelry article.

13. The jewelry article of claim 12 wherein the rounded portions of each of said hearts abut one another.

14. The jewelry article of claim 13 wherein a precious or semi-precious gem stone is set between said rounded heart portions.

15. The jewelry article of claim 1 which is in the form of a necklace.

16. The jewelry article of claim 1 which is in the form of a bracelet.

17. A reversible ornamental article of jewelry having decorative finishes on both sides comprising:

a. a plurality of link members, each of said link members having a geometric configuration that differs from the geometric configuration of an adjacent link member;

b. means to hingably secure adjacent link members to one another to collectively form a flexible strand of ornamental jewelry having a substantially planar upper surface, a substantially planar lower or reverse surface and opposed ends, the geometric configuration of said link members in said upper planar surface being different from the geometric configuration of said link members in said lower or reverse planar surface;

c. connecting means to secure said links together whereby the jewelry article is reversible; and, d. means to secure said opposed ends to another.

18. The jewelry article of claim 17 wherein the geometric configuration of said link members is selected from the group consisting of X-shaped members, hexagonal shaped members, heart shaped members, elongated diamonds, elongated oblongs, elongated rectangles and mixtures thereof.

19. The jewelry article of claim 17, which is in the form of a necklace.

20. The jewelry article of claim 17, which is in the form of a bracelet.

* * * * *